US007673552B2

(12) United States Patent
Herbage

(10) Patent No.: US 7,673,552 B2
(45) Date of Patent: Mar. 9, 2010

(54) COUNTERMEASURE SYSTEM AND METHOD OF USING THE SAME

(75) Inventor: David W. Herbage, Jackson, TN (US)

(73) Assignee: Kilgore Flares Company, LLC, Toone, TN (US)

( * ) Notice: Subject to any disclaimer, the term of this patent is extended or adjusted under 35 U.S.C. 154(b) by 847 days.

(21) Appl. No.: 10/722,234

(22) Filed: Nov. 25, 2003

(65) Prior Publication Data

US 2007/0006721 A1 Jan. 11, 2007

(51) Int. Cl.
*F41F 3/04* (2006.01)

(52) U.S. Cl. ..... 89/1.8; 89/1.816; 89/1.819

(58) Field of Classification Search ..... 89/1.8, 89/1.816, 1.815, 1.819
See application file for complete search history.

(56) References Cited

U.S. PATENT DOCUMENTS 2,993,411 A * 7/1961 Goldsmith ..... 89/1.8
3,245,318 A * 4/1966 Finkelstein et. al. ..... 89/1.809
4,149,166 A * 4/1979 Null ..... 342/13
4,305,325 A * 12/1981 Lange et al. ..... 89/1.815
4,646,618 A * 3/1987 Kurth et al. ..... 89/1.816
4,662,265 A * 5/1987 Becker et al. ..... 89/37.09
4,681,014 A * 7/1987 Gassler et al. ..... 89/1.816
4,934,271 A * 6/1990 Kensok et al. ..... 102/293
5,425,514 A * 6/1995 Grosso ..... 244/3.22
5,875,993 A 3/1999 Weiss et al.
6,230,629 B1 5/2001 Doctor et al.
6,543,716 B1 4/2003 Miller et al.
6,561,074 B1 5/2003 Engel et al.
6,575,400 B1 6/2003 Hopkins et al.
6,603,421 B1 8/2003 Schiff et al.
6,610,971 B1 8/2003 Crabtree
6,715,397 B2 * 4/2004 Bar ..... 89/41.02
6,820,531 B1 * 11/2004 Cianciolo ..... 89/41.02
2003/0160129 A1 8/2003 Berry et al.

* cited by examiner

*Primary Examiner*—Michelle Clement
(74) *Attorney, Agent, or Firm*—H. Roy Berkenstock; Sarah Osborn Hill; Wyatt, Tarrant & Combs, LLP

(57) ABSTRACT

The present invention relates to a countermeasure system having a substantially vertical launch tube that is at least generally rotatable about a vertical reference axis that extends through and along a length of the launch tube. This rotation capability of the launch tube may be used to affect an aiming of an associated countermeasure cartridge at least generally disposed therein. One or both the launch tube and countermeasure cartridge of this countermeasure system are generally equipped with a rotation inhibitor for substantially preventing independent rotation of the countermeasure cartridge relative to the launch tube at least when the countermeasure cartridge is disposed within the launch tube. The present invention is also designed to enable the associated countermeasure cartridge to be pitched over to a predetermined pitch angle (relative to the reference axis of the launch tube) to affect a desired flight path after launch of the countermeasure cartridge.

10 Claims, 5 Drawing Sheets

COUNTERMEASURE SYSTEM AND METHOD OF USING THE SAME

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention generally relates to marine vessels, and more particularly to a marine vessel countermeasure system for addressing an incoming threat (e.g., anti-ship missile) to the marine vessel.

BACKGROUND OF THE INVENTION

A number of devices have been employed on naval ships for protection from, among other threats, anti-ship missiles. These anti-ship missiles exhibit a wide variety of missile technologies including infrared-seeking and/or radar-guided missiles. Various countermeasure systems, have been employed in naval ships to protect against these anti-ship missiles, for example, by providing false signals to "confuse" guidance and/or fire control systems of the anti-ship missiles.

Conventional countermeasure systems (e.g., the MK 36 launcher system) are generally mounted on the ship's main deck. These launchers typically include any appropriate number (e.g., six) of launch tubes (e.g., 130 mm diameter) that are fixed in orientation (e.g., some at 45 degrees and some at 60 degrees) relative to the ship's main deck. Further, each countermeasure cartridge is generally designed to protrude out from or extend beyond the corresponding launch tube with which it is associated. The design, orientation, and location of these conventional launchers at least generally increases both the radar cross-section (e.g., visibility) and the visual outline of the ship. As another example of conventional countermeasure systems, what are referred to in the art as "trainable" launchers are also generally mounted on the ship's main deck, often protruding above the deck even further than the fixed angle MK 36. Accordingly, these trainable launchers present an even less stealthy profile than the MK 36 and additionally take up a significant portion of deck space. In the cases of both the MK 36 and trainable launchers, multiple launchers are positioned at a plurality of locations on the main deck of the ship. For example, two launchers may be positioned near the fore end of the ship, and two launchers may be positioned near the aft end of the ship.

In light of conventional ship-detecting systems, future surface combat ships (e.g., DD(X), CG(X), and LCS (Littoral Combat Ship)) are being designed as "stealthy smart" ships. That is, these combat ships are preferably being configured to avoid (or at least reduce a tendency for) detection of the same. Indeed, these combat ships are being designed to preferably exhibit minimum signatures across the electromagnetic spectrum (e.g., including RF (radar), visual, and IR (infrared) wavelengths). In order to achieve such a stealthy profile, the ships will ideally be low in the water, have sloped sides, and/or have no unnecessary protrusions above the main deck. Accordingly, employment of the above-described conventional countermeasure systems on the decks these combat ships will most likely take up significant amounts of space on the main deck, as well as at least generally reduce the preferred stealthy profiles of such ships.

SUMMARY OF THE INVENTION

Accordingly, It is an object of the present invention to provide a countermeasure system that promotes a stealthy characteristic of a marine vessel. It is another object of the present invention to provide a countermeasure system that is space-efficient. It is still another object of the present invention to provide a countermeasure system capable of effecting launch and deployment, from one or more substantially vertical launch tubes, of one or more expendable countermeasure cartridges. Relatedly, it is yet another object to provide a countermeasure system that may launch/deploy and/or control a countermeasure using at least one predetermined parameter relating to one or more of time, altitude, attitude (e.g., azimuth), location, and distance to enhance protection of the intended marine vessel. These objectives, as well as others, may be met by the countermeasure system and related methods herein described. While the countermeasure systems and related methods disclosed herein are generally described with regard to protection of marine vessels (e.g., ship, submarine, or the like) from incoming threats (e.g., anti-ship missiles), the present invention may have appropriate application in some land-based military vehicles as well.

In a first aspect, the present invention is directed to a countermeasure system that includes a base, a launch tube interconnected with the base, and a reference axis that extends along a length of and through the launch tube. Moreover, this launch tube associated with first aspect of the present invention is at least generally rotatable both relative to the base and about the reference axis.

Various refinements exists of the features noted in relation to the subject first aspect of the present invention. Further features may also be incorporated in the subject first aspect of the present invention as well. These refinements and additional features may exist individually or in any combination. For instance, the reference axis may be characterized as being fixed in a substantially vertical orientation. That is, the reference axis may be said to be, at least in one embodiment, oriented at a substantially right angle relative to the plane of the horizon. As another feature, the countermeasure system of this first aspect may include a servo motor that is at least generally interconnected with the launch tube. More particularly, in one embodiment, at least a portion of the base (of the countermeasure system) may be said to be disposed between this servo motor and the launch tube.

Still with regard to the first aspect of the present invention, the countermeasure system may also include an outer tube. More particularly, at least a portion of the launch tube is preferably disposed within this outer tube. Moreover, the reference axis preferably extends along a length of the outer tube as well as the length of the launch tube. This arrangement of the launch tube and the outer tube may, at least in one embodiment, be characterized as a "tube-in-tube" design of sorts. While the outer tube may exhibit a number of appropriate relationships relative to the base of the countermeasure system, the outer tube is preferably substantially immobile relative to the base. Moreover, while the outer tube may exhibit a number of appropriate relationships relative to the launch tube, the launch tube is preferably rotatable within and relative to the outer tube.

Yet still with regard to the first aspect, the countermeasure system may include a countermeasure cartridge. Moreover, at least a portion of the countermeasure cartridge is at least generally disposable in the launch tube. That is, all or part of the countermeasure cartridge may be positioned within the launch tube (e.g., prior to launch of the cartridge therefrom). In one embodiment, one of the countermeasure cartridge and the launch tube is equipped with a protrusion (e.g., projection, outcropping, or the like), and the other is equipped with a groove complimentarily configured to accommodate the protrusion. Moreover, a length of this groove is preferably substantially parallel to the reference axis at least when the countermeasure cartridge is disposed within the launch tube. Due to this design of the countermeasure system, it may be said, at least in one embodiment, that the countermeasure cartridge is at least generally forced to rotate along with the launch tube relative to the base of the countermeasure system. In another embodiment, at least one of the countermeasure cartridge and the launch tube includes a feature for providing a zero-twist rifling of the countermeasure cartridge relative to the launch tube. For instance, an obturator (e.g., a device for making at least part of the launch tube what may be characterized as at least generally gas-tight) associated with the countermeasure cartridge may engage one or more grooves defined in the launch tube to facilitate inhibition of independent cartridge rotation relative to the launch tube.

A second aspect of the present invention is directed to a marine vessel that is equipped with a countermeasure system. The countermeasure system associated with this second aspect includes a base that is generally interconnected with the marine vessel, a launch tube interconnected with the base, and a countermeasure cartridge, at least a portion of which is disposable within the launch tube. In addition, the countermeasure system associated with this second aspect includes a rotation inhibitor for substantially preventing rotation of the countermeasure cartridge relative to the launch tube at least when the countermeasure cartridge is disposed within the launch tube.

Various refinements exists of the features noted in relation to the subject second aspect of the present invention. Further features may also be incorporated in the subject second aspect of the present invention as well. These refinements and additional features may exist individually or in any combination. For instance, the rotation inhibitor may refer to a combination of a guide key associated with the launch tube, and a keyway defined in the countermeasure cartridge. Preferably, this keyway is at least generally complimentarily configured to accommodate the guide key. In one embodiment, this guide key may be said to be movable (e.g., slidable, pivotable, or the like) between at least first and second positions. In such an embodiment, the first position may include the guide key being disposed within the keyway, and the second position may include the guide key being dissociated from (e.g., disposed outside of or retracted from) the keyway. Yet another embodiment may be equipped with a guide key positioner of sorts for at least generally assisting in moving the guide key between the above-described first and second positions. For instance, this guide key positioner may refer to a key ramp disposed toward an end of the keyway most remote from a nose of the countermeasure cartridge. As the countermeasure cartridge leaves the launch tube, the guide key may come into contact with the key ramp and move from the first position to the second position.

By contrast, other embodiments of the countermeasure system associated with the second aspect may be equipped with a rotation inhibitor that has the guide key being associated with the countermeasure cartridge and the keyway being defined in the launch tube. Yet other embodiments may characterize the rotation inhibitor as a zero-twist rifling feature.

As an example of another refinement to the countermeasure system associated with the second aspect of the present invention, one or both the countermeasure cartridge and the launch tube may include portions of a digital data link (e.g., for relaying flight control parameters between a logic center associated with the marine vessel and the internal control means, such as a microchip, of said countermeasure cartridge). This data link may be utilized to convey flight parameters from the marine vessel's control center (e.g., computer system) to the countermeasure cartridge. For example, these flight parameters may dictate when and/or where (in the countermeasure cartridge's flight path) one or more canards of the cartridge are activated or deployed (e.g., to at least generally assist in pitching the countermeasure cartridge). Related to these canards, the countermeasure cartridge may also be equipped with one or more spring-loaded fins toward the aft end that may deploy upon that aft portion of the countermeasure cartridge clearing the launch tube to at least assist in the desired flight characteristics of the countermeasure cartridge. The number, location, design, and orientation of the fins (if any) may vary as appropriate in other embodiments of the invention. Somewhat relatedly, the countermeasure cartridge may be equipped with an onboard gyroscopic stabilization system. This onboard gyroscopic stabilization system may be said, at least in one embodiment, to at least generally assist in controlling roll, pitch, and/or yaw (e.g., lateral angular deviation from a line of flight) of the countermeasure cartridge (e.g., via the canards) after launch.

In another embodiment, the countermeasure cartridge may include at least one supplemental thruster disposed toward a nose of the countermeasure cartridge. The supplemental thruster(s) may enable alteration and/or maintenance of a flight path of the countermeasure cartridge after launch. In yet another embodiment employing rocket propulsion, the countermeasure cartridge may be equipped with one or more supplemental thrust vector control vanes. The control vane(s) may be disposed toward the aft end of the cartridge and/or may be utilized to at least generally affect the flight path of the countermeasure cartridge by directing at least some of an exhaust plume generated from the rocket propulsion.

Still with regard to the second aspect of the present invention, the marine vessel may be characterized as having a vessel reference axis that extends between a fore end and an aft end of the marine vessel. Further, the launch tube of the countermeasure system may include a vertically oriented tube reference axis that is substantially perpendicular to the vessel reference axis. Yet further, the launch tube (and in some embodiments, other portions of the countermeasure system, up to the entirety thereof) may be rotatable about the tube reference axis relative to a remainder of the marine vessel. While the countermeasure system may be disposed in a number of appropriate ship locations, the countermeasure system is preferably (at least in some stealthy marine vessels) disposed below an uppermost deck of the marine vessel.

Yet a third aspect of the present invention is directed to a method of using a countermeasure system. In this method, a launch tube of the countermeasure system is rotated. This rotation at least generally affects a launch attitude (e.g., azimuth) of a countermeasure cartridge of the countermeasure system. As an additional step, the countermeasure cartridge is launched from the launch tube.

Various refinements exists of the features noted in relation to the subject third aspect of the present invention. Further features may also be incorporated in the subject third aspect of the present invention as well. These refinements and additional features may exist individually or in any combination. For instance, predetermined flight parameters are preferably provided to the countermeasure cartridge prior to launch. In one embodiment, the launch tube of the countermeasure system is rotated, these predetermined flight parameters are provided to the countermeasure cartridge, and the same is launched all within no more than about 2.0 seconds, preferably within no more than about 1.4 seconds, more preferably within no more than about 1.2 seconds, and even more preferably within no more than about 1.0 second.

With regard to the rotation of the launch tube associated with this third aspect, in one embodiment, other portions (in addition to the launch tube) of the countermeasure system may be rotated relative to a remainder of a corresponding marine vessel. As another refinement, the method may include rotating a plurality of launch tubes of the countermeasure system. In one embodiment having a plurality of launch tubes, all the launch tubes may be rotated to a substantially similar degree (e.g., to launch multiple countermeasure cartridges having substantially similar launch attitudes in response to one or more incoming anti-ship missiles). By contrast, in another embodiment, at least a one launch tube may be rotated more or less than a second launch tube of the countermeasure system. In such an embodiment, a first launch azimuth of a first countermeasure cartridge associated with the first launch tube is generally different than a second launch azimuth of a second countermeasure cartridge associated with the second launch tube. In one characterization, it may be said that this feature of the countermeasure system enables a plurality of countermeasure cartridges with different azimuths to be launched in response to multiple incoming anti-ship missiles.

In the case of this third aspect of the present invention, the launched countermeasure cartridge may be pitched to a predetermined angle (relative to a vertical and/or horizontal flight path) at at least one of a predetermined time and a predetermined distance from the launch tube. This pitching of the countermeasure cartridge may occur at one or more predetermined points (or ranges) along the flight path of the same. A payload (e.g., infrared generating decoys, radar reflective decoys, active electronic decoys, and/or the like) of the launched countermeasure cartridge may be deployed at at least one of a predetermined time and a predetermined distance from the launch tube. This deployment of at least some of the associated payload may occur at one or more predetermined points (or ranges) along the flight path of the countermeasure cartridge.

While the present invention is directed to countermeasure applications, it should be noted that the invention may have application with regard to other launchable projectiles (e.g., missiles). Moreover, each of the various features discussed herein in relation to one or more of the described aspects of the present invention may generally be utilized by any other aspect(s) of the present invention as well, alone or in any combination.

DETAILED DESCRIPTION OF THE DRAWINGS

Figure 1:
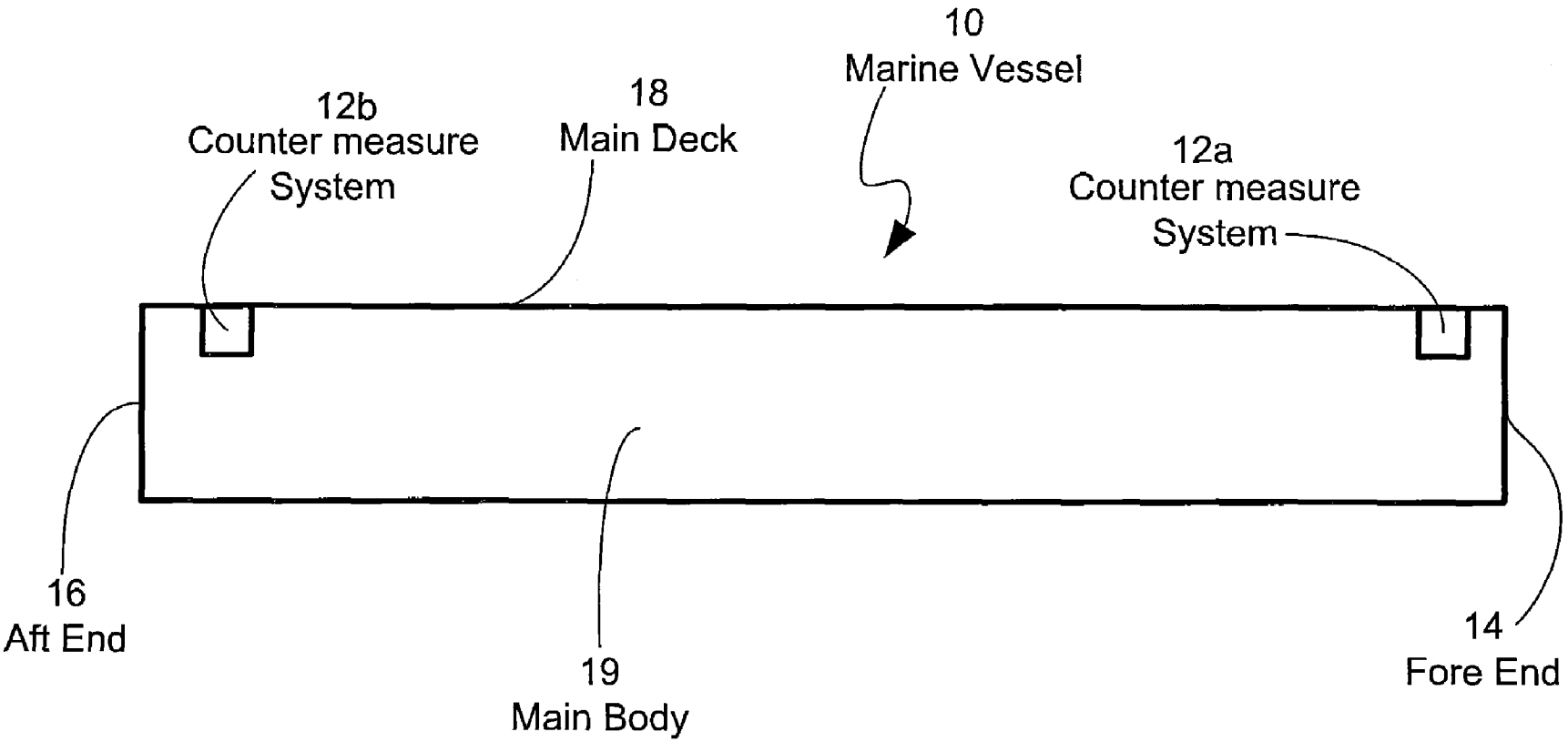
FIG. 1 is a schematic box diagram of a marine vessel equipped with a plurality of countermeasure systems.

The present invention will now be described in relation to the accompanying drawings, which at least assist in illustrating the various pertinent features thereof. FIG. 1 is a diagrammatic representation of one embodiment of a marine vessel 10 that includes a plurality (here, two) of countermeasure systems 12, each including at least one appropriate launcher assembly (e.g., 20 of FIG. 2) and at least one appropriate countermeasure cartridge (e.g., 50 of FIG. 3). More particularly, a first countermeasure system 12*a* is disposed toward a fore end 14 of the marine vessel 10, and a second countermeasure system 12*b* is disposed toward an aft end 16 of the marine vessel 10. It should be noted that numerous other locations for the countermeasure systems 12 may be appropriate. Moreover, the number of countermeasure systems 12 with which the marine vessel 10 is equipped may also vary from one marine vessel to the next to meet desired specifications. For instance, one marine vessel may be equipped with only one countermeasure system 12, while another marine vessel may be equipped with more than two (e.g., three, four, five, or more) countermeasure systems 12.

Still with regard to FIG. 1, the countermeasure systems 12 are located at least generally below a main deck 18 of the marine vessel 10. In other words, the countermeasure systems 12 are located at least substantially within the main body 19 of the marine vessel 10. It should be noted, however, that, in some embodiments, a portion(s) of at least one of the countermeasure systems 12 may be disposed above the main deck 18 of the marine vessel 10. Incidentally, it should be noted that the marine vessel 10 may be any appropriate marine vessel including, but not limited to, boats, ships, submarines, and the like. Moreover, it should be noted that FIG. 1 is merely a diagrammatic representation of a marine vessel 10, and, accordingly, FIG. 1 is not meant to be indicative of the size, shape, and/or contour of the marine vessel 10 or the countermeasure systems 12 (or the components thereof).

In the case that the marine vessel 10 of FIG. 1 is a naval ship, the marine vessel 10 may be designed to exhibit at least generally sloped sides (e.g., to enhance radar deflecting capabilities). As a result, this design may at least generally limit or reduce the size of the main deck 18 (relative to conventional naval vessels). One beneficial feature of the below-deck locations of the countermeasure systems 12 is that such an arrangement enhances a reduced radar cross-section (relative to locations of conventional above-deck countermeasure systems), thus promoting a desired stealthy profile of the marine vessel 10. Since a minimum of above-deck equipment is at least generally desired to accomplish such stealth, it is preferred that most if not substantially all weapon systems (e.g., guns, anti-ship missiles, surface to air missiles, anti-submarine weapons, as well as the countermeasure systems 12) be located below the main deck 18. Since it is preferred that these weapon systems be launched/fired through hatches or other appropriate passages in the main deck 18, these weapon systems are preferably located just below the main deck 18. Moreover, many other systems (e.g., communications, radar, and other basic operations systems) are preferably located immediately below the main deck 18. With the foregoing preferences in mind, the space available that is immediately underneath the main deck 18 may be characterized as a premium. This desire for space efficiency reveals another benefit of the countermeasure systems 12 in that they include one or more launch apparatuses (e.g., 20 of FIG. 2) preferably having one or more substantially vertically-oriented launch tubes (e.g., 24 of FIG. 2). This vertical orientation of the launch tubes at least generally assists in conserving lateral below-deck space (or deck space in embodiments having at least a portion of the assembly that extends above the main deck surface) for other systems and/or equipment.

Figure 2:
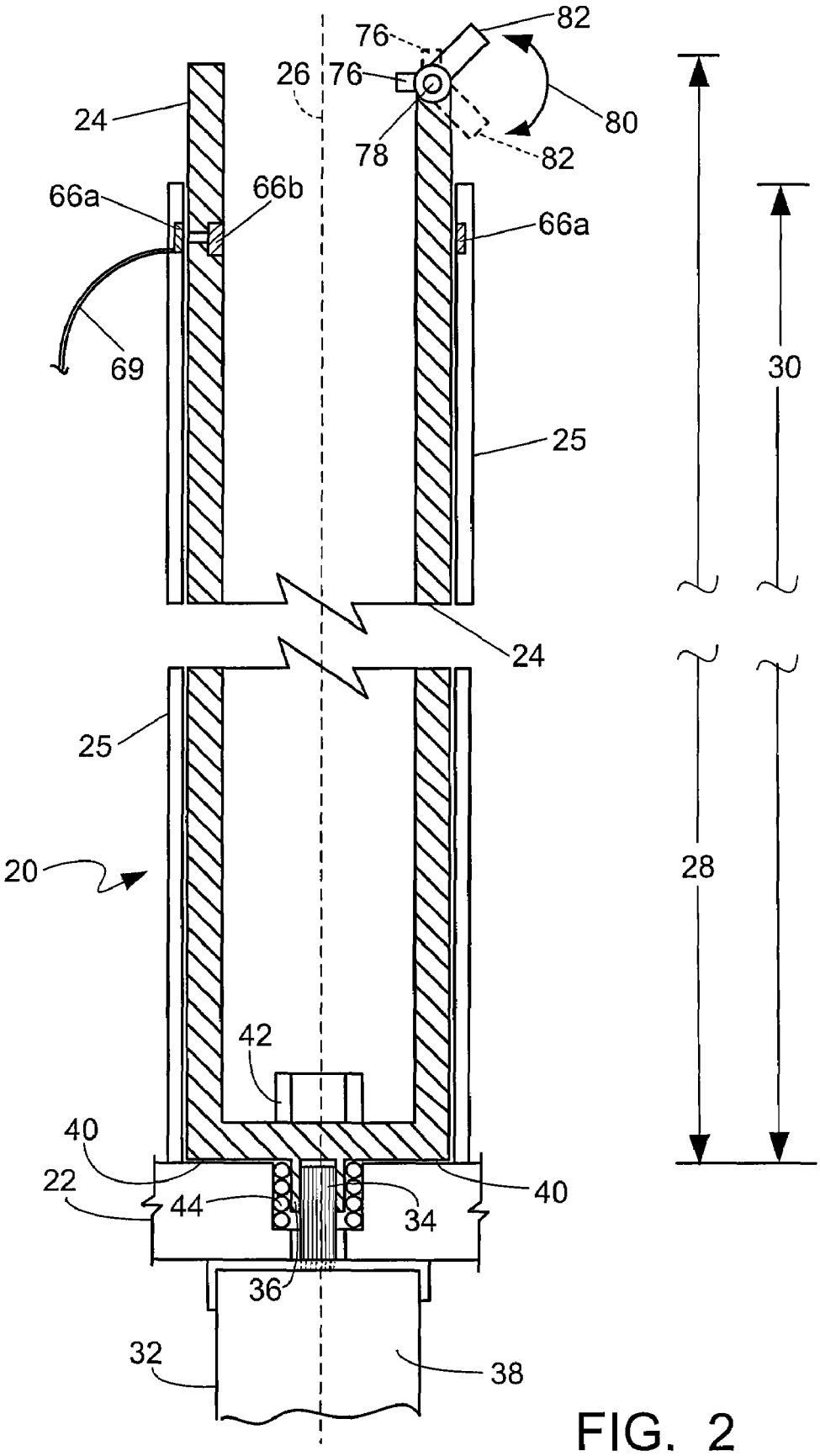
FIG. 2 is a cross-sectional side view of a launcher assembly.

Turning to FIG. 2, a launcher assembly 20 is shown that includes (among other features) a launch tube 24 and an imaginary reference axis 26 that extends along a length 28 of the launch tube 24. This reference axis 26, and, accordingly, the length 28 of the launch tube 24 are preferably fixed in a substantially vertical orientation. Again, this vertical orientation provides a benefit of the launcher assembly 20 occupying an at least generally reduced amount of lateral space on the marine vessel 10 (relative to conventional countermeasure systems). In addition to the launch tube 24, the launcher assembly 20 includes an outer tube 25. As illustrated in FIG. 2, at least a portion of the launch tube 24 is disposed within this outer tube 25. Moreover, the reference axis 26 extends along a length 30 of the outer tube 25 as well as the length 28 of the launch tube 24. This outer tube 25 is substantially immobile relative to a base 22 of the launcher assembly 20. Accordingly, the outer tube 25 is preferably interconnected (or even integral) with the base 22 in a manner that does not enable significant independent movement of the outer tube 25 relative to the base 22. With regard to the base 22, it is preferably the feature by which the launcher assembly 20 is interconnected with the marine vessel 10. Herein, "interconnected" or the like generally refers to something being either directly or indirectly connected (or caused to be connected) with something else.

FIG. 2 also illustrates that the launcher assembly 20 includes a servo motor 32 that is at least generally interconnected with the launch tube 24. More particularly, a splined shaft 34 of the servo motor 32 is engaged with an appropriate slip fitting 36 of the launch tube 24. Other embodiments may exhibit other appropriate manners of interconnecting the servo motor 32 and the launch tube 24. This servo motor 32 may be any appropriate mechanism(s) capable of providing rotational movement and/or force (e.g., torque) to the launch tube 24. While this launcher assembly 20 is shown as having only one servo motor 32 and one launch tube 24, other embodiments may include a plurality of servo motors 32 and/or launch tubes 24. It is, however, preferred that each servo motor 32 be associated with only one launch tube 24 to provide individual rotational control of each launch tube 24 as further described herein.

A portion of the base 22 is shown in FIG. 2 as being disposed between the servo motor 32 and the launch tube 24. A body 38 of the servo motor 32 is shown as being attached to the base 22 (via any appropriate attachment mechanism such as one or more of mechanical fasteners, welds, adhesives, and the like). However, the splined shaft 34 of the servo motor 32 is not directly attached to the base 22 and can thus rotate relative to the base 22. Since the launch tube 24 is interconnected with the servo motor 32 (via engagement of the shaft 34 and the fitting 36), the launch tube 24 is also capable of rotating relative to the base 22. To facilitate rotation of the launch tube 24 relative to the base 22 of the launcher assembly 20, an appropriate bearing surface (e.g., polytetraflouroethylene, one or more thrust bearings, or the like) 40 is found at least generally between the base 22 and the launch tube 24. Indeed, the launcher assembly 20 is preferably designed to enable the launch tube 24 to rotate up to 360 degrees or more.

Still referring to FIG. 2, based on the position of the reference axis 26, which extends through a substantially central location of the launch tube 24, the launch tube 24 at least generally rotates about the reference axis 26 (e.g., at least when the servo motor 32 is activated). Yet further, since the outer tube 25 is substantially immobile relative to the base 22, another characterization of the launch tube 24 is that the launch tube 24 is rotatable or at least movable relative to the outer tube 25. Herein, "rotatable" or the like generally refers to a capability to at least generally spin or turn around or about (e.g., around or about an axis or center).

Figure 3:
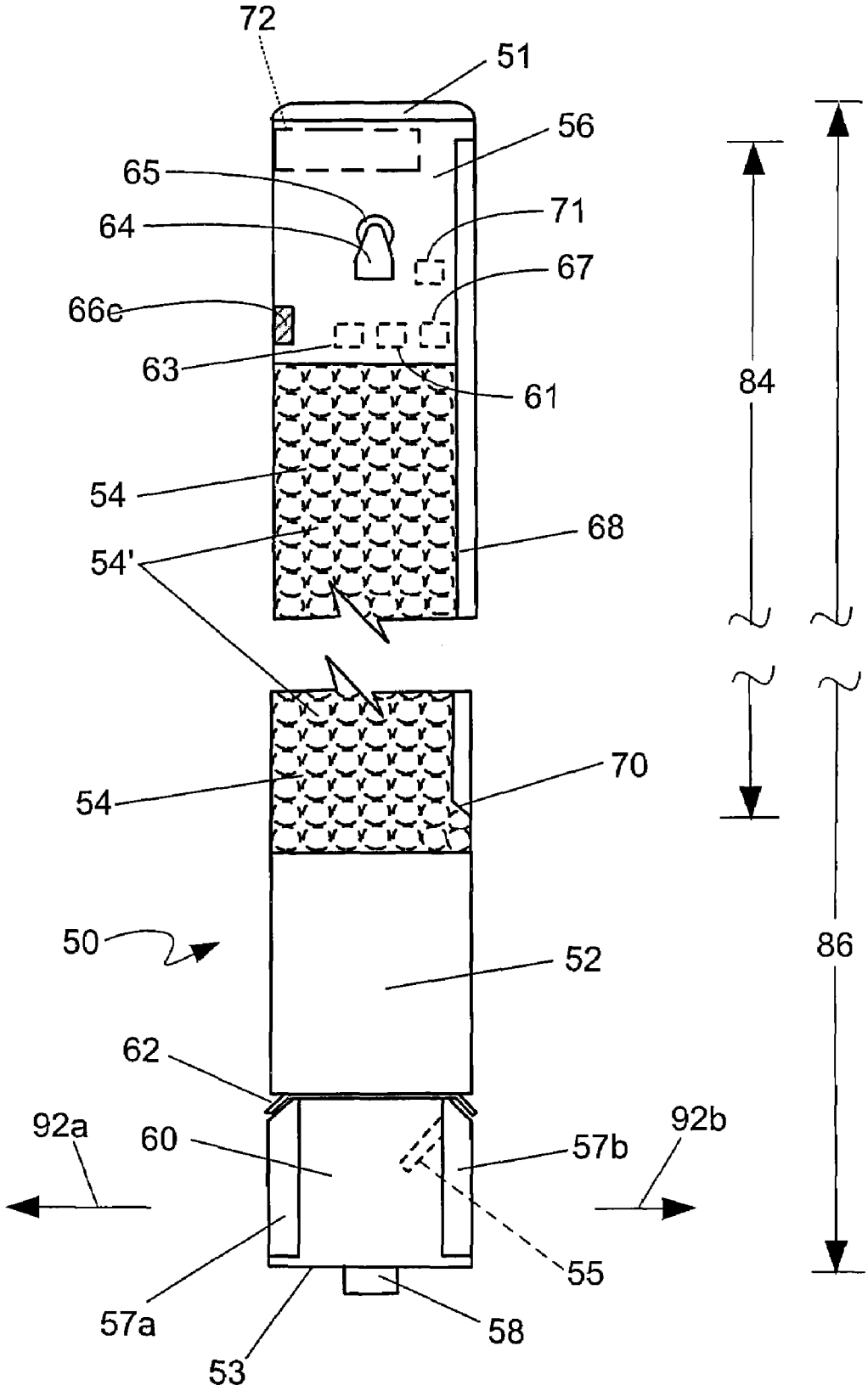
FIG. 3 is a side view of a countermeasure cartridge.

As yet other features shown in FIG. 2, the countermeasure launcher apparatus 20 also includes one or more primary firing coils 42 for at least assisting in the launch of a countermeasure (e.g., 50, FIG. 3). However, other embodiments may include any of a number of appropriate alternative mechanisms for at least assisting in the launch of a countermeasure.

Yet further, the launcher assembly 20 of FIG. 2 includes a spring 44 disposed at least generally about the splined shaft 34 of the servo motor 32 between the base 22 and the launch tube 24. This spring 44 at least generally hinders the transfer of recoil energy (e.g., from launching a countermeasure) to the servo motor 32 of the launcher assembly 20. Moreover, the interface of the launch tube 24 with the base 22 (via the bearing surface 40) at least generally facilitates the transfer of such recoil energy from the launch tube 24 to the base 22 of the countermeasure launch assembly 20. This design provides the benefit of at least generally reducing the tendency for damage of the servo motor 32 by deterring at least some of the recoil energy imposed thereon. Moreover, this design also provides the benefit of transferring the recoil energy to the base 22 (and, thus, preferably the support structure of the marine vessel 10) to at least generally diminish or prevent a significant "footprint" that would enable detection of the marine vessel 10 (e.g., by the enemy).

FIG. 3 illustrates a countermeasure cartridge 50 that is at least generally disposable in the launch tube 24 of the launcher assembly 20 of FIG. 2. In other words, all or part of the countermeasure cartridge 50 is positionable within the launch tube 24 (e.g., prior to launch of the cartridge 50 therefrom). This countermeasure cartridge 50 includes a nose 51 and an opposing tail 53. In addition, toward the tail 53, the cartridge includes at least one propulsion means (e.g., rocket motor, impulse assembly, mortar assembly, and/or the like) 52. This propulsion means 52 is generally disposed between the nose 51 and a secondary firing coil 58 associated with the tail 53 of the countermeasure cartridge 50. Between this secondary firing coil 58 and the propulsion means 52 is a fin cup 60 equipped with a plurality of spring-loaded fins 57*a*, 57*b*. These fins 57*a*, 57*b* preferably deploy outward in the general directions indicated by arrows 92*a*, 92*b* (respectively) upon that portion of the countermeasure cartridge 50 exiting or clearing the launcher assembly 20. These fins 57*a*, 57*b*, may be said to at least generally assist in stabilizing the flight path of the countermeasure cartridge 50 after launch of the same.

An obturator 62 is at least generally disposed between the propulsion means 52 and the fin cup 60. This obturator 62 may be said, at least in one embodiment, to substantially prevent escape of exhaust plume gas (exiting the fin cup 60) from the launch tube 24 until the cartridge 50 (or at least the obturator 62 thereof) has left the launch tube 24. Accordingly, employment of this obturator 62 in the design of the countermeasure cartridge 50 at least generally enhances initial launch thrust provided by the propulsion means 52 and may be said to at least generally promote a zero-twist rifling feature of the countermeasure system 12. In the case that the countermeasure cartridge 50 employs rocket propulsion, the same may be equipped with one or more supplemental thrust vector control vanes 55 disposed toward the aft end 53 of the cartridge 50 to at least generally affect the flight path of the countermeasure cartridge 50 by directing at least some of an exhaust plume generated from the rocket propulsion.

Between the propulsion means 52 and the nose 51, the countermeasure cartridge 50 also includes at least one payload section 54 for at least temporarily containing (e.g., until deployment of the same) one or more appropriate decoys 54', such as, but not limited to, infrared and/or radar-reflecting decoys. Herein, "decoy" refers to any device utilized to at least generally deceive, distract, divert, lead, and/or lure away an incoming threat (e.g., of the marine vessel 10), as well as any device utilized to destroy or deactivate such an incoming threat. Release or deployment of one or more of these decoys from the payload section 54 may be accomplished in any of a number of appropriate manners known in the art.

Between the nose 51 and this payload section 54 of the countermeasure cartridge 50 is a first canard 64 and a second canard (disposed on an opposing side of the countermeasure cartridge 50). Herein, unless specifically stated otherwise, reference to the canard(s) 64 may be generalized to both the first and second canards. In any event, these canards 64 may be characterized as airfoils that are at least generally disposed more toward the nose 51 of the countermeasure cartridge 50 than toward the tail 53. While the countermeasure cartridge 50 is described as having two canards 64, other embodiments may have a single canard 64 or more than two (e.g., three, four, five, or more) canards 64. At least one of these canards 64 is preferably equipped with an appropriate mechanism 65 to enable the canard(s) 64 to be folded down (e.g., at least generally against or near the side of the countermeasure cartridge 50) in what may be characterized as an "inactive" condition, and to be flipped out in what may be characterized as an "active" condition to assist in controlling, facilitating, or at least generally affecting the flight of the countermeasure cartridge 50.

Between the payload section 54 and the nose 51 of the countermeasure cartridge 50 of FIG. 3 is an appropriate internal control means 56. This internal control means 56 preferably includes an appropriate microprocessor control unit 61, one or more appropriate canard control modules 63, and at least one timing device 67 (e.g., a digital timing device such as Airtronic's AOTC Cube/Relay Timer). Moreover, as an optional feature, the countermeasure cartridge 50 may include one or more supplemental thrusters 72 disposed toward the nose 51 of the countermeasure cartridge 50. In FIG. 3, the countermeasure cartridge 50 is shown equipped with one such supplemental thruster 72 at least generally disposed between the nose 51 and the first canard 64. The supplemental thruster(s) 72 may be said to at least generally assist in the alteration and/or maintenance of a flight path of the countermeasure cartridge 50 after launch. It should be noted that any appropriate number and location(s) of the supplemental thruster(s) 72 may be appropriate based on, inter alia, desired flight characteristics of the countermeasure cartridge 50.

FIGS. 2-3 show that the countermeasure cartridge 50 and the launch tube 24 may include portions of a digital data link 66 (e.g., optical, magnetic, or other appropriate data link) for relaying flight control parameters between a logic center (e.g., via a digital control buss interconnected with the digital data link 66 by an appropriate connector 69) associated with the marine vessel 10 and the countermeasure cartridge 50. More particularly, this digital data link 66 includes a first component **66*a* that is substantially annularly disposed about a potion of the outer tube 25 that faces the inner tube 24. The inner tube 24 is equipped with a second component 66*b* of the digital data link 66 that, due to the substantially annular design of the first component 66*a*, can at least receive data signals substantially regardless of the degree of rotation of the inner tube 24 about the reference axis 26 relative to the outer tube 25. Further, the countermeasure cartridge 50 includes yet a third component 66*c* of the digital data link 66 that is disposed on the countermeasure cartridge 50 in an appropriate location to be substantially aligned with the second component 66*b* when the countermeasure cartridge 50 is appropriately positioned within the launch tube 24 as described below. Signals received by the third component 66*c* can be sent to one or more of the microprocessor control unit 61, canard control module(s) 63, and the timing device(s) 67 of the countermeasure cartridge 50 to at least generally control or affect flight parameters of the countermeasure cartridge 50**.

The countermeasure cartridge 50 of FIG. 2 also includes an onboard gyroscopic stabilization system 71. This onboard gyroscopic stabilization system preferably at least generally assists in controlling one or more of the roll, pitch, and yaw of the countermeasure cartridge 50 after launch of the same. This is accomplished, at least in part, by the onboard gyroscopic stabilization system 71 at least indirectly providing signals to the mechanism(s) 65 that controls the movement and orientation of the canard(s) 64 to thus cause change and/or maintenance of the position(s) of the canard(s) 64. Other embodiments of the countermeasure cartridge 50 may not include this stabilization system 71.

Incidentally, conventional solutions for controlling countermeasures cartridges launched from some typical countermeasure systems include complete guidance packages disposed therein. In these conventional approaches, the guidance packages may utilize one or more of GPS, radar, and inertial guidance technology. The design and location of conventional countermeasure control systems has generally demanded a considerable amount of time for downloading the digital data necessary for appropriate launch and guidance of the countermeasure cartridge. Not only are these conventional control systems temporally inefficient, locating these expensive control systems on the cartridge (which are generally expended on one use) results in undesired expenses associated with using these systems.

By contrast, the control module 56 of the countermeasure cartridge 50 does not include a GPS system, radar guidance system, or inertial guidance system. Employment of the above-described components of the control module 56 enable the desired flight parameters of the countermeasure cartridge 50 to be received from the marine vessel's computer system and carried out during the flight of the countermeasure cartridge 50 as a function of time from launch and/or distance (e.g., from the launcher assembly 20 or the marine vessel 10). This design of the countermeasure system 12 beneficially enables the same to be manufactured efficiently (e.g., down to about 1/10 or less) relative to convention countermeasure systems employing GPS, radar, or inertial guidance systems. As another benefit, this countermeasure system 12 enables data relating to desired flight parameters to be conveyed to and received (e.g., downloaded) by the control module 56 of the countermeasure cartridge 50 in times that are significantly less than those afforded by conventional solutions. This is significant benefit of the countermeasure system 12, as response time tends to be critical and may determine (or at least affect) whether the marine vessel 10 is damaged by one or more incoming threats.

Figure 4:
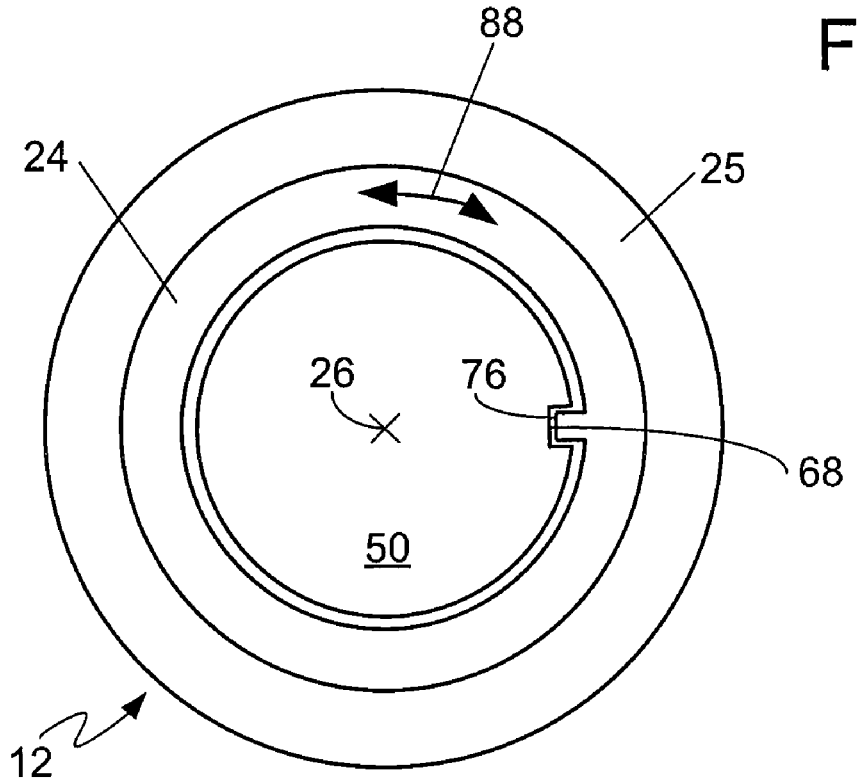
FIG. 4 is a cross-sectional view of a relationship between a launch tube and a countermeasure cartridge when the countermeasure cartridge is disposed within the launch tube.

Referring to both FIGS. 1-5, the countermeasure system 12 (again, including at least one launcher assembly 20 and at least one countermeasure cartridge 50) includes what may be characterized as a rotation inhibitor of sorts for substantially preventing rotation of the countermeasure cartridge 50 relative to the launch tube 24 at least when the countermeasure cartridge 50 is disposed within the launch tube 24. Referring to FIGS. 2-4, the rotation inhibitor here refers to a combination of at least one guide key 76 (e.g., protrusion, projection, outcropping, or the like) associated with the launch tube 24, and at least one keyway 68 (e.g., groove, channel, or the like) defined in the countermeasure cartridge 50. A length 84 of the keyway 68 is preferably substantially parallel to the reference axis 26 at least when the countermeasure cartridge 50 is disposed within the launch tube 24. While the countermeasure system 12 (launcher assembly 20 and the countermeasure cartridge 50) is illustrated as having only one guide key 76 and one key way 68, other embodiments of the countermeasure system 12 may employ a plurality of guide keys 76 and keyways 68. It is, however, preferred that the number of guide keys 76 utilized is equal to the number of keyways 68 utilized. Moreover, while the keyway 68 is illustrated in FIG. 3 as extending only partially along a length 86 of the countermeasure cartridge 50, other embodiments may include keyways 68 having other appropriate lengths 84 up to being substantially equal to the length 86 of the countermeasure cartridge 50. In any event, this keyway 68 shown in FIG. 3 is at least generally complimentarily configured to accommodate the guide key 76. In other words, the keyway 68 and guide key 76, in combination, are preferably designed to exhibit an insignificant amount of lateral space between the two (when the countermeasure cartridge 50 is disposed within the launch tube 24). Again, this provides a benefit of at least generally preventing significant rotation of the countermeasure cartridge 50 relative to the launch tube 24 at least while the countermeasure cartridge 50 is disposed within the launch tube 24. Due to this preferred design of the countermeasure system 12, the countermeasure cartridge 50 is at least generally forced to rotate along with the launch tube 24 at least in one of the general directions indicated by arrow 88 about the reference axis 26. Another way of stating this would be to say that this preferred design of the countermeasure system 12 at least generally prevents significant independent rotation of the countermeasure cartridge 50 relative to the launch tube 24 (at least when the countermeasure cartridge 50 is disposed within the launch tube 24).

Referring to FIG. 2, the guide-key 76 associated with the launcher assembly 20 is shown as being movable (e.g., pivotable, or the like) about an appropriate axis 78 (e.g., a bolt) in the general directions indicated by arrow 80. Accordingly, the guide key 76 (including a switch 82 associated therewith) may be characterized as being at least generally movable between a first position indicated by the solid-lined drawing of the guide key 76 (and the switch 82) in which the guide key 76 is in an active condition and capable of engaging the keyway 68, and second position indicated by the dashed-lined drawing of the guide key 76 (and the switch 82) in which the guide key 76 is in an inactive condition and not capable of engaging the keyway 68. In other words, the first position may include the guide key 76 being disposed within the keyway 68, and the second position may include the guide key 76 being dissociated from (e.g., disposed outside of or retracted from) the keyway 68.

Referring to FIG. 3, the countermeasure cartridge 50 is also equipped with a guide key positioner of sorts for at least generally assisting in moving the guide key 76 between the above-described first and second positions. More particularly, this guide key positioner refer to a key ramp 70 disposed toward an end of the keyway 68 most remote from the nose 51 of the countermeasure cartridge 50. As the countermeasure cartridge 50 leaves the launch tube 24, vertical movement of the countermeasure cartridge 50 is accompanied by movement of the keyway 68 along the guide key 76. This movement generally brings the guide key 76 into contact with the key ramp 70, and facilitates movement of the guide key 76 from the first position to the second position (FIG. 2).

Figure 5:
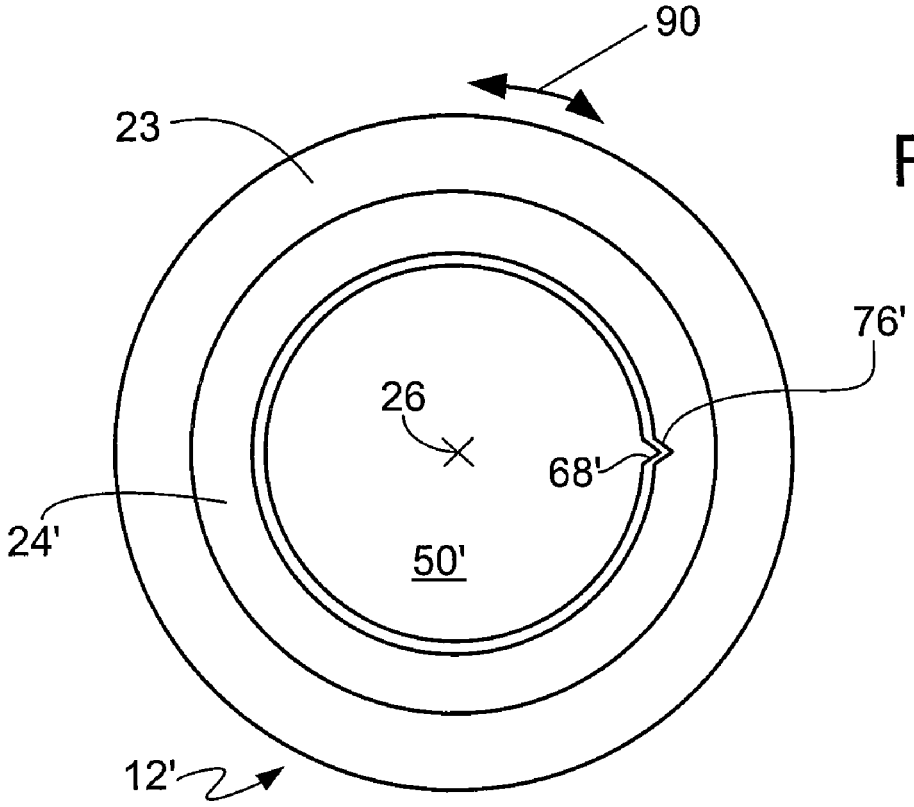
FIG. 5 is a cross-sectional view of another relationship between a launch tube and a countermeasure cartridge when the countermeasure cartridge is disposed within the launch tube.

FIG. 5 illustrates another embodiment of a countermeasure system 12, and, accordingly, where appropriate, a single prime designation is utilized to indicate the various differences between the countermeasure system 12 and the countermeasure system 12'. In this embodiment, the rotation associated with the countermeasure system 12' is defined by the guide key 68' being associated with the countermeasure cartridge 50' and the keyway 76' being defined in the launch tube 24'. As with the countermeasure system 12, the keyway 68' shown in FIG. 5 is at least generally complimentarily configured to accommodate the guide key 76'. That is, the keyway 68' and guide key 76', in combination, are preferably designed to exhibit an insignificant amount of lateral space between the two. Again, this provides a benefit of at least generally preventing significant rotation of the countermeasure cartridge 50' about the axis 26 relative to the launch tube 24' at least while the countermeasure cartridge 50' is disposed within the launch tube 24'. This, again, at least generally forces the countermeasure cartridge 50' to rotate along with the launch tube 24', and/or at least generally prevents significant independent rotation of the countermeasure cartridge 50' about the axis 26 relative to the launch tube 24'.

While the countermeasure system 12' illustrated in FIG. 5 has only one guide key 76' and one key way 68', other embodiments of the countermeasure system 12' may employ a plurality of guide keys 76' and keyways 68'. Moreover, yet other embodiments may include both one or more guide key 76/keyway 68 combinations (such as that of FIGS. 2-4) and one or more guide key 76'/keyway 68' combinations (such as that of FIG. 5). In any event, numerous sizes, shapes, and dimensions of the guide keys 76, 76' and keyways 68, 68' may be appropriate for the embodiments discussed herein. It is, however, preferred that the designs of the guide key (e.g., 68, 68') and the keyway (e.g., 76, 76') be appropriate to enable accommodation of the guide key by the keyway and to at least generally prevent significant independent rotation of the countermeasure cartridge (e.g., 50, 50') about the reference axis 26 relative to the launch tube (e.g., 24, 24'). Still other embodiments may include other rotation inhibitors that achieve what may be characterized as a zero-twist rifling feature of the countermeasure cartridge relative to the launch tube, and, accordingly, are hereby within the scope of this disclosure.

Still referring to FIG. 5, the countermeasure system 12' is distinguished from that of FIGS. 2-4 in that another component 23 of the countermeasure system 12' is capable of rotating about the reference axis 26 (e.g., in substantial chorus with the launch tube 24') at least in the directions indicated by arrow 90. This additional component 23 may refer to any appropriate component of the countermeasure system 12' such as, but not limited to, a peripheral tube, a firing mechanism, a support structure, and the like.

Figure 6:
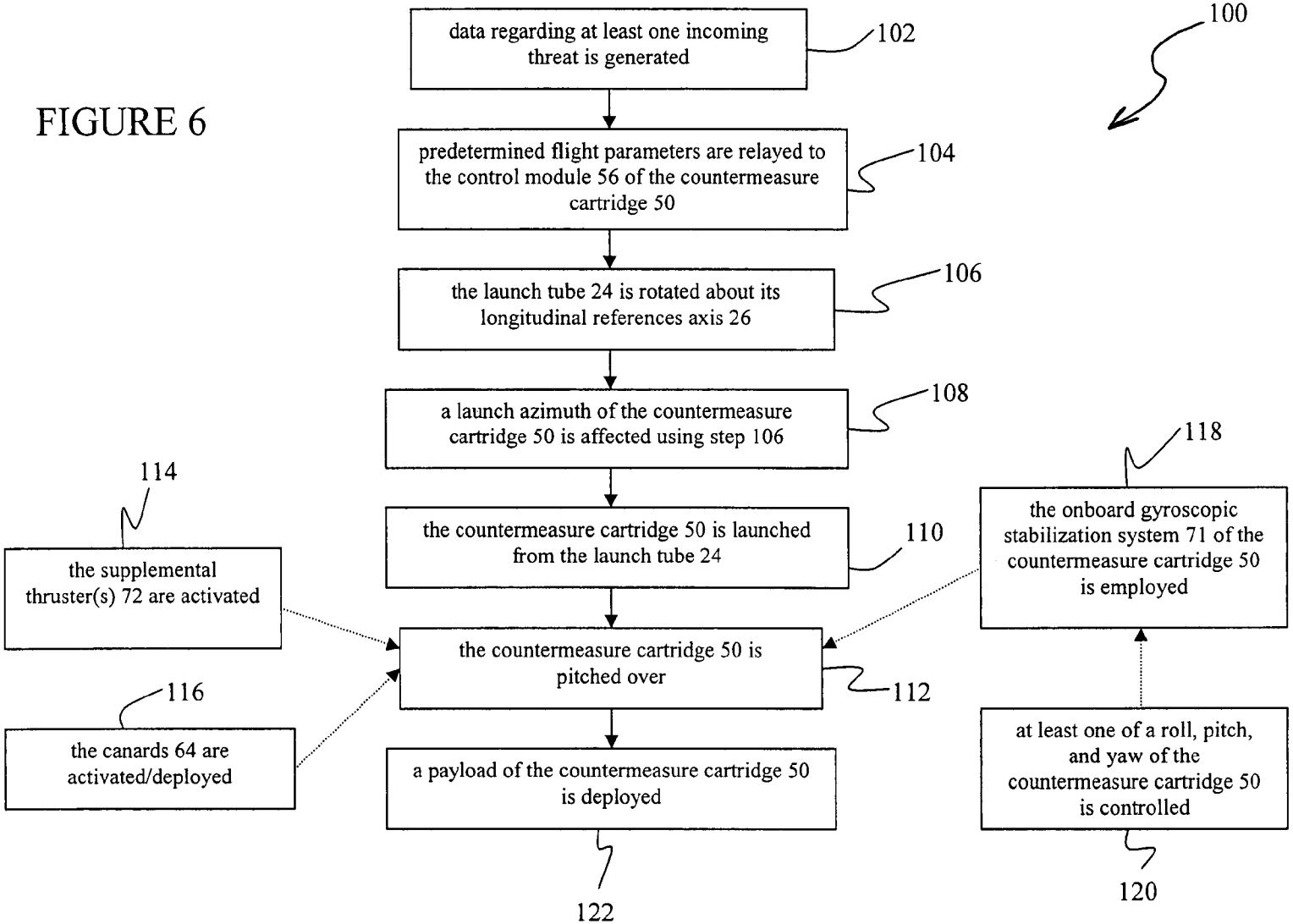
FIG. 6 is diagrammatic representation of a protocol for using a countermeasure system.

FIG. 6 illustrates a protocol 100 for using a countermeasure system. While the protocol 100 may refer to any of a number of embodiments of appropriate countermeasure systems, the countermeasure system 12 will be utilized in the description of the protocol 100 for illustrative purposes.

As a first step 102 in this protocol 100, data regarding at least one incoming threat (e.g., anti-ship missile) is generated. For instance, an appropriate sensor system (e.g., radar) of the marine vessel 10 preferably generates data on a variety of factors utilized to generate predetermined flight parameters for the countermeasure cartridge 50 including, but not limited to, velocity and direction of the marine vessel 10, velocity and direction of the incoming threat, sea conditions, and wind conditions. The marine vessel's computer system may then calculate flight parameters, launch timing and/or launch azimuth of the countermeasure cartridge 50 based on such factors. The predetermined flight parameters are preferably relayed to the control module 56 of the countermeasure cartridge 50 as shown in step 104. The launch tube 24 of the countermeasure system 12 may be rotated about its longitudinal reference axis 26 in response to the predetermined flight data received by the control module 56 and/or through independent launch timing and/or launch azimuth signals conveyed to the launcher assembly 20 (step 106). Incidentally, in other embodiments, this step 106 may include the rotation of a plurality of launch tubes 24. This rotation of the launch tube 24 may generally be said to affect a launch azimuth of the countermeasure cartridge 50 (step 108). For example, the rotation of the launch tube 24 may at least assist in "aiming" the countermeasure cartridge 50, so that one launch and tip-over (initial pitching utilizing the canards 64) have occurred, the direction of flight of the countermeasure cartridge 50 is preferably in agreement with the parameters computed by the marine vessel's computer system (e.g., to enable desired delivery/deployment of the cartridge's payload). This feature, in combination with the control module 56 (and the predetermined flight parameters therein), enables the countermeasure cartridge 50 to be effectively launched and flown without the use of a GPS, radar, or other conventional guidance package.

In one embodiment having a plurality of launch tubes 24, rotation of all the launch tubes 24 to a substantially similar degree may enable the launch multiple countermeasure cartridges 50 having substantially similar launch azimuths in response to one or more incoming threats. By contrast, in another embodiment, rotation of at least one launch tube 24 more or less than another launch tube 24 of the countermeasure system 12 preferably enables a launch azimuth of one countermeasure cartridge 50 to be generally different than another launch azimuth of the other countermeasure cartridge 50. This feature of such a countermeasure system 12 enables a plurality of countermeasure cartridges 50 with different azimuths to be launched in response to multiple incoming threats. In any event, after appropriate rotation of the launch tube 24, the countermeasure cartridge 50 is launched from the launch tube 24 (step 110). Indeed, since time is generally of the essence in response to one or more incoming threats, the combination of all of these steps 102-110 preferably occurs in no more than about 2.0 seconds, more preferably within no more than about 1.4 seconds, even more preferably within no more than about 1.2 seconds, and yet even more preferably within no more than about 1.0 second. Due to the simplicity of this control approach, the download time for the desired flight data is a fraction of that which is currently offered by a conventional guidance packages.

Rotation (step 106) of the launch tube 24 (with the countermeasure cartridge 50 disposed therein) prior to launch (step 108) enables an at least generally desired aiming of the countermeasure system 12. Since at least one of the launch tube 24 and the countermeasure cartridge 50 is keyed to the other, the rotation of the launch tube 24 enables adjustment of a desired launch azimuth of the cartridge 50 (e.g., to enable its canards 64 to appropriately pitch it over (e.g., to a "horizontal" ballistic path) during flight of the countermeasure cartridge 50. In any event, step 112 illustrates that the countermeasure cartridge 50 is preferably pitched at least at some point during flight of the same. Moreover, it is preferred that the countermeasure cartridge 50 is pitched to a predetermined angle (e.g., relative to the reference axis 26) provided by the marine vessel's computer system prior to launch. This step 112 is preferably accomplished at a predetermined time and/or at a predetermined distance from the launch tube 24, again, both predetermined parameters being preferably provided by the marine vessel's computer system prior to the launching step 108. Moreover, this pitching step 112 is preferably facilitated by employment of the timing device 67. For instance, the upward velocity of the launched countermeasure 50 is preferably a known parameter. At a predetermined altitude, as realized (at least in part) utilizing the timing device 67 (which is preferably set to real time at the moment of launch), the canards 64 are activated to pitch the countermeasure 50 over at a predetermined angle (set prior to launch). The supplemental thruster(s) 72 may be utilized to assist the canards 64 with this initial pitch-over.

After the launching step 108 the flight path of the countermeasure cartridge 50 may be affected (e.g., controlled) in one or more of a variety of appropriate manners. For instance, the canards 64 may be activated/deployed (step 114) to affect the flight path and/or assist in the accomplishment of the pitching step 112, and/or the supplemental thruster(s) 72 may be activated (step 116). Further, the onboard gyroscopic stabilization system 71 of the countermeasure cartridge 50 may be employed (step 118) to, for example, to at least assist in the accomplishment of the pitching step 112 and/or control (or at least generally affect) at least one of a roll, pitch, and yaw of the countermeasure cartridge 50 (step 120).

Upon reaching an appropriate point (or range) in the flight path, preferably realized at least in part utilizing the timing device 67, the payload of the countermeasure cartridge 50 is deployed as indicated in step 122. This payload deployment preferably occurs at a predetermined time and/or a predetermined distance from the launch tube 24, both predetermined parameters again preferably being provided by the marine vessel's computer system prior to launch. In some embodiments, this deployment of at least some of the payload may occur at one or more predetermined points (or ranges) along the flight path of the countermeasure cartridge 50. Indeed, use of the velocity, altitude of pitch-over, pitch-over angle, and time to deployment provide the countermeasure system 12 with a beneficial feature of enabling launch of one or more countermeasure cartridges 50 at advantageous angles, distances, altitudes, and times. Moreover, the accuracy of the countermeasure cartridge 50 fight path may be further enhanced by employment of the onboard gyroscopic stabilization system 71 to control, via the canards 64, roll, pitch, and/or yaw subsequent to the initial pitch-over and at least until the deployment of the countermeasure payload.

The selection of and the control settings for each countermeasure cartridge 50 to be launched is preferably generated by the marine vessel's sensors, processed by its fire control system, and relayed via its digital buss to the countermeasure system(ies) 12. The above-described approach preferably enables the invention to simultaneously select multiple, launch tube-specific, aim points for each countermeasure cartridge 50 in order to simultaneously track and/or counter multiple incoming threats.

Those skilled in the art will now see that certain modifications can be made to the assembly and related methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

What is claimed is:

1. A countermeasure system for vertically launching a self-propelled countermeasure cartridge trained only in azimuth comprising:

a base for supporting the system;

a launch tube having a central axis, the tube being disposed substantially vertically on the base, the tube having a zero twist longitudinal keyway therein for effecting non-rotational, axial movement relative thereto;

means for rotating the launch tube about its axis for training the countermeasure cartridge in azimuth while disposed on the base;

a countermeasure cartridge receivable within the tube, having propulsion means for launching the cartridge longitudinally out of the tube along its axis;

the countermeasure cartridge having a guide key cooperable with the tube longitudinal keyway said guide key and said keyway being disposed for interaction to effect non-rotational axial movement throughout a substantial portion of the launch such that the countermeasure cartridge remains trained in azimuth;

the countermeasure cartridge having a canard disposed thereon for adjustment of the pitch of the cartridge during flight after launch from the tube.

2. The countermeasures system as claimed in claim 1 wherein the launch tube is housed in an outer tube affixed to the base.

3. The countermeasures system as claimed in claim 1 wherein the tube longitudinal keyway and the countermeasure cartridge guide key provide for rotation-free launch of the countermeasure cartridge with respect to the launch tube.

4. The countermeasures system as claimed in claim 3 wherein the rotation of the launch tube sets the launch azimuth orientation and course of the countermeasure cartridge and the actuation of the canard statically adjusts pitch angle and ballistic trajectory of the countermeasure cartridge.

5. The countermeasures system as claimed in claim 1 includes a thruster disposed substantially perpendicular to the axis of the countermeasure cartridge for selective adjustment of the course of the cartridge after launch from the launch tube.

6. The countermeasures system as claimed in claim 5 wherein the countermeasure cartridge includes internal control means preprogrammed for activation of the thruster.

7. The countermeasures system as claimed in claim 1 wherein the countermeasure cartridge includes internal control means preprogrammed for activation of the canard.

8. The countermeasures system as claimed in claim 1 wherein the countermeasure cartridge includes an onboard gyroscopic stabilization system to control at least one of roll, pitch and yaw of the countermeasure cartridge after launch.

9. The countermeasures system as claimed in claim 8 wherein the gyroscopic stabilization system is linked to a data base prior to launch of the countermeasure cartridge whereby updated flight and countermeasure information is provided to the system.

10. The countermeasure system as claimed in claim 1 wherein the countermeasure cartridge contains a releasable decoy.

* * * * *